US005875406A

United States Patent [19]

Weber

[11] Patent Number: 5,875,406

[45] Date of Patent: Feb. 23, 1999

[54] METHOD FOR REDUCING RADIOACTIVE WASTE, PARTICULARLY OILS AND SOLVENTS

[75] Inventor: Adolphe Weber, Rouhling, France

[73] Assignee: Bernatom S.A.R.L., Rouhling, France

[21] Appl. No.: 860,873

[22] PCT Filed: Jan. 12, 1995

[86] PCT No.: PCT/FR95/00041

§ 371 Date: Jul. 14, 1997

§ 102(e) Date: Jul. 14, 1997

[87] PCT Pub. No.: WO96/21933

PCT Pub. Date: Jul. 18, 1996

[51] Int. Cl.[6] ..... G21F 9/00

[52] U.S. Cl. ..... 581/1; 588/20; 208/181; 210/682

[58] Field of Search ..... 588/1, 20; 208/181; 210/682

[56] References Cited

U.S. PATENT DOCUMENTS

| | | | |
|---|---|---|---|
| 4,615,794 | 10/1986 | Belanger . | |
| 4,681,705 | 7/1987 | Robertson . | |
| 4,925,597 | 5/1990 | Ganter . | |
| 5,075,044 | 12/1991 | Augem . | |
| 5,196,113 | 3/1993 | Metz | 210/181 |
| 5,516,969 | 5/1996 | Krasznai et al. | 588/20 |

FOREIGN PATENT DOCUMENTS

| | | |
|---|---|---|
| 35 22 126 | 1/1987 | Germany . |
| 36 44 396 | 2/1988 | Germany . |
| 3 026 999 | 2/1991 | Japan . |

OTHER PUBLICATIONS

"Method and Apparatus for Waste Oil Regeneration", *Chemical Abstracts*, vol, 115, No. 22, Dec. 2, 1991.

*Primary Examiner*—Ngoclan Mai
*Attorney, Agent, or Firm*—Young & Thompson

[57] ABSTRACT

A method for reducing radioactive waste, particularly oils and solvents in nuclear power stations and military research centers, and a device therefor. The method comprises feeding the waste into a tank (1) in which it is continuously stirred, preheating the waste, performing a chemical precipitation treatment, feeding the mixture into a centrifuge (2), performing an electrostatic or conventional filtration step, and testing the level of radioactivity. The treatment is continuously repeated until the desired level of decontamination is reached.

6 Claims, 2 Drawing Sheets

METHOD FOR REDUCING RADIOACTIVE WASTE, PARTICULARLY OILS AND SOLVENTS

BACKGROUND OF THE INVENTION

The present invention relates to the field of treatment of radioactive waste, particularly oils and solvents, in particular from nuclear power plants and in military research centers, and has for its object a process for reduction of waste suitable for this purpose.

The invention also has for its object a device for practicing this process.

DESCRIPTION OF THE RELATED ART

At present, the elimination of contaminated oils or solvents poses a great problem in nuclear power plants and in military research centers. Active oils used in these power plants are of the mineral or synthetic type. There is meant by contaminated oil an oil containing radioactive substances. Until now, the known processes for the decontamination of contaminated oils and solvents are centrifugation, decantation, filtration over rare earth and bacterial destruction.

To this end, there is known from DE-A 3 522 126, a process for the centrifugation of radioactive wastes and drying the solid residues. Also, JP-A-63 204 198 discloses a process of centrifugation and filtration of radioactive effluents containing an oily portion. There is also known, from WO-A-89 08316, a process for treatment of effluents of low radioactivity by preheating to eliminate volatile solvents, then by special centrifugation followed by filtration. Finally, the publications INSTITUTE OF ELECTRICAL ENGINEERS, STEVENAGE, GB Inspec. No. 3106590 SIMIELE G A et al. "Radioactive decontamination of waste oil by filtration, centrifugation, and chelation" and NUCLEAR AND CHEMICAL WASTE MANAGEMENT, 1987, UK, Vol. 7, No. 3–4, page(s) 257–263, ISSN 0191-815X disclose the decontamination of oily wastes from pressurized water reactors. This process suggests prefiltration which removes large particles, this prefiltration being followed by centrifugation adapted to eliminate water. The oily residue is then treated by chelating agents such as E.T.D.A., and the emulsion is again subjected to centrifugation. However, the use of chelating agents gives rise to serious problem of elimination of wastes from nuclear power plants.

Moreover, these processes are often very long or incomplete, in particular in the case of centrifugation and filtration. Thus, these processes, which are suggested for the treatment of aqueous effluents, permit lowering the radioactivity of the oils but not eliminating or reaching levels equal to natural radioactivity. As a result, these oils, as well as the contaminated solvents, are generally simply stored at the site, awaiting a technical solution, whereby the active wastes encumber the sites and constitute a permanent pollution danger.

SUMMARY OF THE INVENTION

The invention has for its object to overcome these drawbacks.

It thus has for its object a process for the reduction of radioactive wastes, particularly oils and solvents, particularly from nuclear power plants and military research centers, characterized in that it consists essentially in dumping said wastes into a reservoir, in which they are subjected to continuous agitation, preheating them, carrying out a chemical precipitation treatment, passing the mixture into a centrifuge, carrying out electrostatic or conventional filtration and then testing the level of radioactivity, the treatment being performed continuously until the desired level of decontamination is reached.

The invention also has for its object a device for practicing this process, essentially constituted by a contaminated waste reservoir connected by means of forward and return conduits and by a circulation pump, to a filtration element, characterized in that it is provided moreover, between the contaminated waste reservoir and the filtration element, with a centrifuge adapted to carry out separation of water that may be contained in the wastes and to carry out the separation of the large contaminated particles, so as to limit the consumption of the filtering elements, in that the reservoir is provided with a mixture and a heating means and in that the filtration element is constituted by at least one electrostatic collector or a conventional filter, the assembly of the elements being controlled and monitored by means of a control panel.

BRIEF DESCRIPTION OF THE DRAWINGS

The invention will be better understood from the following description, which relates to a preferred embodiment, given by way of non-limiting example, and explained with reference to the accompanying schematic drawings, in which.

DESCRIPTION OF THE PREFERRED EMBODIMENTS

Figure 1:
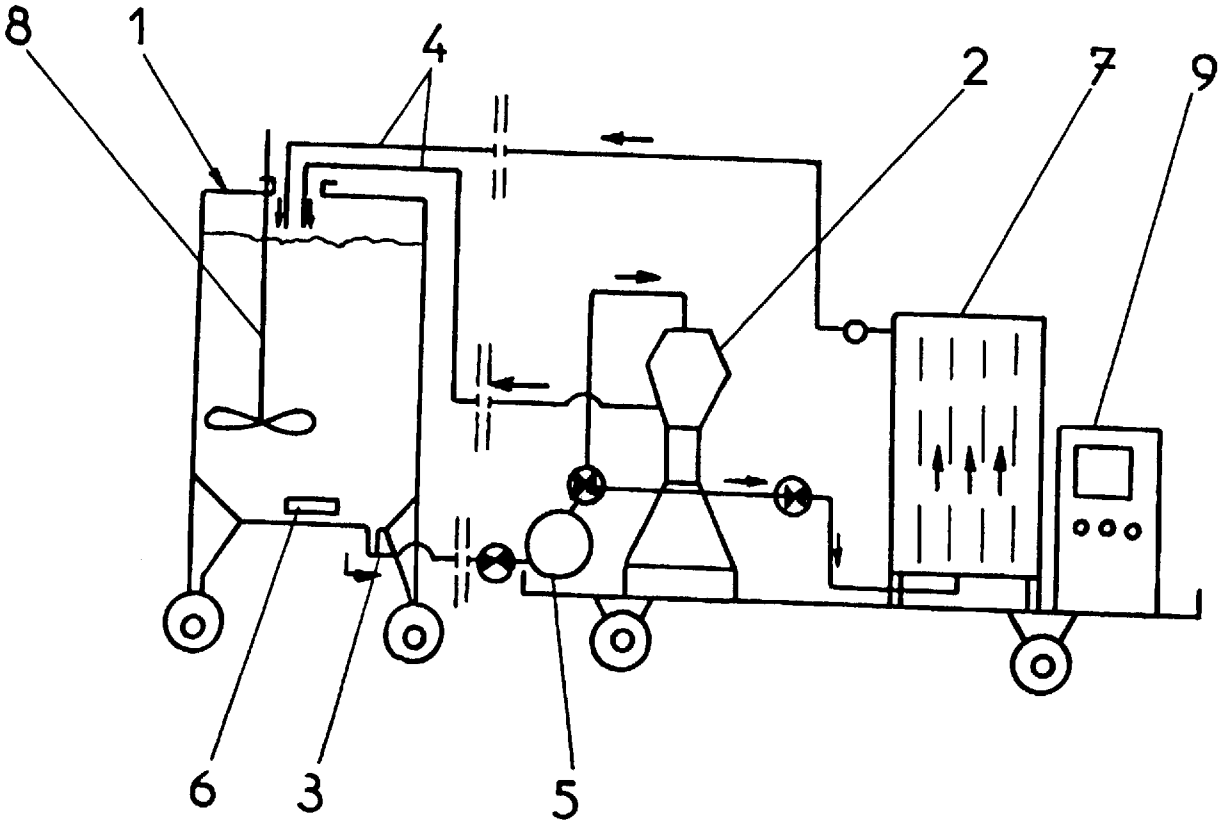
FIG. 1 is a side elevational and cross-sectional view of a device for practicing the process according to the invention.

According to the invention and as shown more particularly in FIG. 1 of the accompanying drawings, the process for reduction of radioactive wastes, particularly from oils and solvents, consists essentially in pouring said wastes into a reservoir 1, in which they are subjected to continuous agitation by means of a mixer 8, in preheating the latter by means of heating means 6, carrying out a chemical treatment by precipitation, passing the mixture into a centrifuge 2 via supply conduits 3 and return conduits 4 and a pump 5, carrying out electrostatic or conventional filtration in a filtration element 7, and then testing the radioactivity level, all of the operations being controlled and monitored by means of a control panel 9, the treatment being continuously performed until the desired decontamination level is reached, by returning the treated waste by means of a return conduit 4 to the reservoir 1.

According to one characteristic of the invention, the preheating of the waste by heating means 6 is preferably carried out at a temperature comprised between 15° C. and 80° C.

This process is carried out by means of a device essentially constituted by a reservoir 1 for contaminated waste, connected by means of supply conduits 3 and return conduits 4 and by a circulation pump 5, to a filtration element 7, this device being characterized in that it is provided moreover, between the contaminated waste reservoir 1 and the filtration element 7, with a centrifuge 2 adapted to carry out the separation of any water contained in the waste and to carry out the separation of the large contaminated particles, in that the reservoir 1 is provided with a mixer 8 and a heating means 6 and in that the filtration element 7 is constituted by at least one electrostatic collector or a conventional filter, the assembly of these elements being controlled and monitored by means of a control panel 9.

The filtration element 7 is constituted by one or several electrostatic collectors or by conventional filters, whose waste supply is carried out in their lower portion by means of the circulation pump 5, this or these electrostatic collectors being connected at their upper portion to the return conduit 4, as shown in FIG. 1 of the accompanying drawings, or the conventional filters being connected in their lower portion to the return conduit 4, their supply being carried out from above. This modification is not shown in the accompanying drawings.

The electrostatic collector or collectors or conventional filter or filters forming the filtration element 7 are preferably provided with removable and interchangeable paper filter elements. Thus, by periodically changing the paper filter elements, the contamination accumulated on these latter can be eliminated with respect to the regulations in force.

The heating means 6, whose thermostat permits adjusting the temperature between 15° C. and 80° C., is adapted to maintain a low and constant viscosity of the waste to be treated during all the duration of the treatment operation and hence to promote good circulation of the waste in the centrifuge 2 and in the filter means 7.

The device is completed by a centrifuge 2 mounted in bypass in the supply conduit 3 and whose contaminated waste outlet is connected to the reservoir 1. Such a centrifuge is adapted to eliminate water such that its level in the contaminated waste will be lower than 500 ppm. A content higher than this value would have the effect of changing the insulating characteristics of the oil and interfering with electrostatic filtration.

Figure 3:
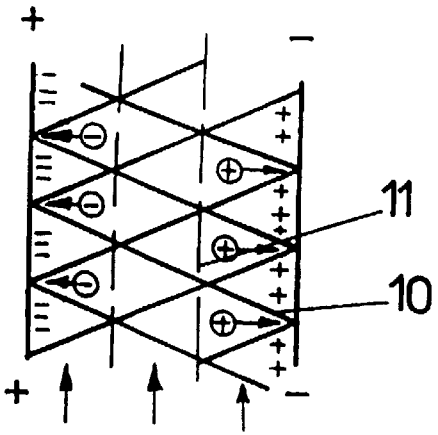
FIG. 3 is a fragmentary schematic side elevational and cross-sectional view showing the operation of an electrostatic collector.
Figure 2:
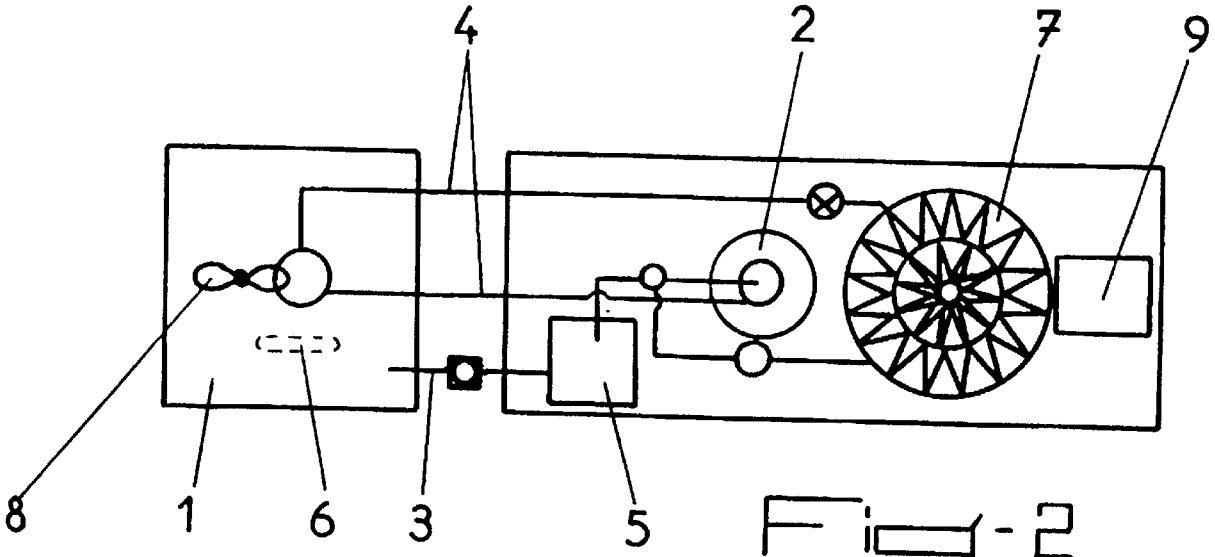
FIG. 2 is a fragmentary plan view of the device.

FIG. 3 of the accompanying drawings shows an electrostatic filtration principle such as is used in the invention. It will be seen from this figure that the particles circulating in an electrical field between a positive electrode and a negative electrode are attracted, as a function of their negative or positive charge, by the two electrodes. By interposition between these electrodes of several collectors, shown by multisheet elements 10, if desired separated from each by screens 11, the charged particles are attracted, as a function of their polarity, against the corresponding filter surface of the multisheet elements 10 and are retained there, such that the contaminated waste discharges during its passage through the collectors, of porous material such as paper, for example according to the vertical arrows shown in the lower portion of FIG. 3, losing all or a portion of its charged particles.

The circulation of the contaminated waste is maintained until a contamination level of a value of the same order as that of natural radioactivity is reached, or an even lower level. The decontaminated oils that are obtained could accordingly be treated in existing recycling installations or installations for the destruction of used oils, for example by incineration in a cement factory.

The active particles generally contained in the radioactive waste, in particular oils and solvents from nuclear power plants, are essentially particles of the type of $^{54}Mn$, $^{58}Co$, $^{59}Fe$, $^{60}Co$, $^{65}Zn$, $^{134}Cs$, $^{137}Cs$, and their treatment by application of the process according to the invention by means of the device described above permits a considerable reduction in the volume and of the weight of the waste by a ratio that can vary between 1:1000 and 1:3000.

In military research centers, the contamination is due essentially to uranium and to other actinides. Among the elements most often encountered can be cited $\mathbf{235}_U$, $\mathbf{236}_U$, $\mathbf{237}_U$, $\mathbf{239}_U$, $\mathbf{239}_{Np}$, $\mathbf{239}_{Pu}$, $\mathbf{241}_{Am}$, $\mathbf{242}_{Cm}$, $\mathbf{238}_{Pu}$, etc. All these alpha emitters are admixed with oil.

The process according to the invention permits trapping all these elements. Thus, the treatment of chemical reduction in the reservoir 1 has for its object to change the metallic ions into metallic elements, which are then retained in the electrostatic collector of the filtration element 7. By way of example, an ion of cobalt ($Co^{++}$) will become ($Co^{o}$) according to the principle ($M^{++}+2e \rightarrow M^{o}$).

According to another characteristic of the invention, to increase the efficiency of reduction, the process consists in adding to the effluent preliminarily a so-called entrainment salt. The ionic valence of the element will determine the type of entrainer used. For a valence order decreasing from 6 to 2, there will be preferably used the disodium acetate, manganese dioxide, zirconium iodate and phosphate, bismuth phosphate, lanthanum fluoride and the chlorides and sulfates of nickel or cobalt. These entrainers are added in the amount of 0.001% to 0.1% by weight.

The oils from nuclear power plants are preferably reduced by use of a boron salt such as particularly sodium borohydride, added in the amount of 0.001% to 0.2% by weight. It is however also possible to use other reducers.

By way of non-limiting example, the decontamination of an oil from the primary pump of a nuclear power plant having a viscosity of 40 Cst and an activity of 180 Bq/l to a value lower than 4 Bq/l has been carried out in the following manner:

preheating to 40° C. to 50° C., the addition of 0.01% by weight of cobalt chloride, the addition of 0.2% by weight of a sodium hydroxide solution NaOH(1N), mixing, the addition of 0.05% by weight of sodium borohydride (NaBH4), mixing, centrifugation and electrostatic filtration.

It is also possible to carry out filtration by a conventional method, the speed of treatment will however be considerably less than that by electrostatic filtration.

Moreover, the process and the device according to the invention permit decontamination by use only of electrical energy which carries out both reheating and circulation of the waste to be decontaminated and the fixation of the active particles in the filtration element. Such a treatment process can be carried out in a semiautomatic manner, human intervention being adapted to be limited to the preliminary chemical treatment and to the replacement of the filter papers.

Thanks to the invention, it is possible to carry out a reduction of radioactive waste by decontamination in an electrostatic field entrapping the active particles in said field.

Of course, the invention is not limited to the embodiment described and shown in the accompanying drawings. Modifications remain possible, particularly as to the construction of the various elements or by substitution of technical equivalents, without thereby departing from the scope of protection of the invention.

I claim:

1. A process for the reduction of radioactive waste containing radioactive metallic ions, comprising the steps of:

forming an oil mixture by pouring the radioactive waste into a reservoir;

subjecting said mixture to continuous agitation;

preheating said mixture to a temperature between 15° C. and 80° C.;

chemically treating said mixture for reduction of the radioactive metallic ions;

passing said mixture through a centrifuge for separation;

carrying out one of electrostatic precipitation and filtration; and testing a level of radioactivity of said mixture, wherein said steps are continued until a predetermined reduction in radioactivity is achieved.

2. The process of claim 1, further comprising the step of adding an entrainment salt to said mixture.

3. The process of claim 2, wherein the entrainment salt used is one of the group consisting of disodium acetate, manganese dioxide, zirconium iodate and phosphate, bismuth phosphate, lanthanum fluoride, and chlorides and sulfates of nickel and cobalt.

4. The process of claim 1, wherein said step of chemically treating said mixture for reduction of the radioactive metallic ions comprises the addition of a boron salt to said mixture.

5. The process of claim 4, wherein said boron salt is sodium borohydride.

6. The process of claim 2, wherein the preheating step preheats said mixture to a temperature between 40° C. and 50° C.; and said chemically treating step comprises adding 0.01% by weight of cobalt chloride, 0.2% by weight of a sodium hydroxide solution NaOH(1N) and mixing said mixture, followed by adding 0.05% by weight of sodium borohydride and mixing said solution.

* * * * *